US005087269A

United States Patent [19]

Cha et al.

[11] Patent Number: 5,087,269

[45] Date of Patent: Feb. 11, 1992

[54] INCLINED FLUIDIZED BED SYSTEM FOR DRYING FINE COAL

[75] Inventors: Chang Y. Cha, Golden, Colo.; Norman W. Merriam; John E. Boysen, both of Laramie, Wyo.

[73] Assignee: Western Research Institute, Laramie, Wyo.

[21] Appl. No.: 563,226

[22] Filed: Aug. 3, 1990

Related U.S. Application Data

[63] Continuation-in-part of Ser. No. 332,138, Apr. 3, 1989, abandoned.

[51] Int. Cl.[5] ..... C10L 9/08; F26B 3/08

[52] U.S. Cl. ..... 44/626; 44/501; 34/22; 34/57 C

[58] Field of Search ..... 44/501, 620, 626; 34/57 R, 57 C, 22

[56] References Cited

U.S. PATENT DOCUMENTS

| | | | |
|---|---|---|---|
| 708,604 | 9/1902 | Welch | 34/57 R |
| 3,755,912 | 9/1973 | Hamada et al. | 34/57 R |
| 4,031,354 | 6/1977 | D'Souza | 34/57 R |
| 4,249,909 | 2/1981 | Comolli | 44/626 |
| 4,495,710 | 1/1985 | Ottoson | 44/626 |
| 4,725,337 | 2/1988 | Greene | 44/626 |

*Primary Examiner*—Carl F. Dees
*Attorney, Agent, or Firm*—John O. Mingle

[57] ABSTRACT

Coal is processed in an inclined fluidized bed dryer operated in a plug-flow manner with zonal temperature and composition control, and an inert fluidizing gas, such as carbon dioxide or combustion gas. Recycled carbon dioxide, which is used for drying, pyrolysis, quenching, and cooling, is produced by partial decarboxylation of the coal. The coal is heated sufficiently to mobilize coal tar by further pyrolysis, which seals micropores upon quenching. Further cooling with carbon dioxide enhances stabilization.

66 Claims, 7 Drawing Sheets

INCLINED FLUIDIZED BED SYSTEM FOR DRYING FINE COAL

This invention was made with Government support under DE-AC21-87MC24268 awarded by the Department of Energy. The Government has certain rights in this invention.

This invention represents a continuation-in-part of Ser. No. 07/332,138, filed Apr. 3, 1989 and now abandoned, entitled Drying Fine Coal in an Inclined Fluidized Bed, the disclosure of which is herein incorporated by reference.

BACKGROUND OF INVENTION

1. Field of Invention

The present invention relates to a process using an inclined fluidized bed for drying and stabilizing coal fines in an environmentally acceptable and safe manner to improve heating value and handling characteristics.

2. Background

Coal is dried for a variety of reasons, such as to save on transportation costs, to increase the heating value, to increase the net dollar value, to prevent handling problems caused by freezing weather, to improve coal quality particularly when used for coking, briquetting, and producing chemicals, to improve operating efficiency and reduce maintenance of boilers, and to increase coke oven capacity. However, drying of coal causes increased dust formation as the dry coal is more friable. Further, reabsorption of moisture must be considered a potential problem.

Dry coal is generally preferred in many coal operations. In World War II the Germans determined that dry coal improved pyrolysis in Lurgi-Spulgas ovens, while the French found that the capacity of coking ovens could be increased by using said coal. Thus, increased tonnages of dry coal were being sold in the United States up to the 1970's when stringent emission standards elevated its cost to an uneconomic level.

Another trend in the coal mining industry was its increased mechanization resulting in an increased percentage of coal fines. Because coal fines have a greater relative surface area, they are very susceptible to water absorption. In order to market such fines, drying was necessary.

Difficulties in coal drying abound. Besides the stringent emissions standards adding an economic burden, numerous explosions and fires have occurred when low-cost air is employed as the drying medium. Coal dust fines are more susceptible to dust explosions than are larger particles (Hertzberg et al., "Domains of Flammability and Thermal Ignitability for Pulverized Coals and Other Dusts: Particle Size Dependences and Microscopic Residue Analysis," 18th International Symposium on Combustion Proceedings, Pittsburgh, Penn, 1982). Often dry coal is treated with heavy oil before shipping to prevent dust formation and the reabsorption of moisture.

Many proposed processes for upgrading coal involve fine grinding and separations in liquids media. The resulting cleaned coal is difficult to handle using conventional techniques because of fine particles and high moisture contents. Additional drying is sometimes employed; however, moisture reabsorption, dust formation with its fire and explosion hazards, and spontaneous heating often result in unstable products.

Typical processes include that of Greene, U.S. Pat. No. 4,725,337, which discloses a process for drying and removing impurities from low rank coal and peat by subjecting the coal to a recycled superheated gaseous medium to desorb the moisture from the coal and produce superheated gases. Another is McMahon, U.S. Pat. No. 4,304,571, which discloses a method for increasing the Btu-value of a solid fuel, for instance, coal, by subjecting it to hydrothermal treatment in the presence of an added decarboxylation catalyst, such as soluble salts of vanadium, copper, nickel or other similar metal. Ruyter et al., U.S. Pat. No. 4,285,140, uses a process for dewatering and upgrading low rank coal by heating a pressurized mixture of coal and water at 150°–300° C. After the water is separated, the coal is further heated to 300°–400° C. under pressure to vaporize additional moisture. Ottoson, U.S. Pat. No. 4,495,710, discloses a process for the rapid fluidized bed heating of coal to mobilize tar with subsequent cooling using a recycle stream. Comolli, U.S. Pat. No. 4,249,909, discloses a hot gas, fluidized bed wicking up process where coal hydrocarbons prevent moisture reabsorption.

The general problem of coal drying represents removing three types of moisture: free, physically bound, and chemically bound. Free moisture is found in the very large pores and interstitial spaces of coal and maybe removed by mechanical means as it exhibits the normal vapor pressure expected of water at that temperature.

Physically bound moisture is more difficult to remove as it is held tightly in small coal capillaries and pores. Because of this, its vapor pressure and specific heat are reduced over that expected of free moisture.

Chemically bound moisture is characterized by a bonding between surfaces and water. Monolayer and multilayer bonding are commonly identified.

Sometimes a fourth type of moisture is identified which comes from the decomposition of organic compounds. It is really not moisture held in coal but is produced during coal decomposition.

Coal drying can be characterized by typical drying curves that exhibit distinct rate regions. Firstly, a transient region occurs as equilibrium conditions are sought while the material heats. This is followed by a largely constant rate portion of drying where the material temperature is relatively constant during the unbound moisture removal, and the drying rate is generally determined from only the particle size and moisture content, be it coal or some other material.

The final region is a period of decreasing rate as the material temperature increases and the physically and chemically bound moisture is removed. For this drying regime the particle size, temperature, and residence time are important parameters. Often the drying rate becomes diffusion controlled, and since diffusivity increases with temperature, higher temperatures are employed to continue drying the materials. Because coal needs to be ideally dried to a very low moisture content, appropriate design for operating in this diffusion controlled region is important.

During the constant rate period, the heat and mass transfer rates are directly proportional to the driving forces of temperature gradient and humidity gradient respectively; the appropriate proportionality constants, however, are usually experimentally determined. Maintaining near maximum values of said gradients become important when effective drying equipment is designed.

Adding oil to dry coal is a common method to prevent moisture reabsorption and autogenous heating. Thus, using 1.5 to 2.0 gallons of No. 6 oil per ton of coal has been shown to be effective for this purpose (Bauer, "Thermal Drying of Western Coal—A Review Paper," Western Regional Conference on Gold, Silver, Uranium, and Coal Proceedings, Rapid City, SD, September 1980). Processes such as oil addition, however, increase operating costs.

Willson et al., "Low-Rank Coal Slurries for Gasification," Fuel Processing Technology, 1987, 15: 157–172, describe a variety of drying techniques to upgrade low rank coals. Included were hot water and steam drying under pressure and hot-gas drying using a rotary kiln, Roto-Louvre dryer or a Perry turbulent entrainment dryer. In this study two bituminous coals, Illinois No. 6 and Pittsburgh No. 8, and Wyoming subbituminous coal were employed. When dried directly in hot gases, the dried coal reabsorbs moisture and returns to nearly the original equilibrium moisture level. In contrast, both steam and hot-water drying produced dried coal in which moisture reabsorption was significantly reduced. At these drying temperatures, 270°–330° C., and under pressure, it was concluded that residual tar in the dried coal significantly helped in reducing the moisture reabsorption. However, the high energy requirements will likely rule out this process for drying ultra-fine, modern-mined coal.

Ultra-fine coal adds two additional problems to any effective thermal drying processes—fines carryover and explosions. Since indirect heating is inefficient as it requires large heat transfer surfaces with a separate heating medium that escalate capital costs, and leads to high maintenance requirements and low throughput, an inert atmosphere is needed with a low gas velocity.

Smith, U.S. Pat. No. 4,170,456, discloses a method for inhibiting the spontaneous combustion of coal char by treating with carbon dioxide to deactivate the char surface to oxygen. The temperature ranged used was 10°–149° C. Since coal char and dried coal are similar, this carbon dioxide treatment would likely reduce the pyrophoric nature of dried coal.

After World War II fluidized bed dryers were adapted to coal drying; however, critical control of both coal and gas flow was required in order to avoid fires and explosions. McNally Flowdryer, Dorr-Oliver Fluo-Solids Dryer, Link-Belt Fluid Flow Dryer, and Heyl and Patterson fluidized bed dryers are all well known.

Typically fluidized bed dryers have a coal-fired zone, using stokers or pulverized coal pneumatically injected, where fluidizing air is heated and its oxygen content reduced. Another zone acts as the dryer where the pressure drop across the gas distributor is large relative to the pressure drop across the bed in order to assure good dryer gas distribution. In some installations, gas from the coal is recycled to further reduce the oxygen concentration. Coal distribution is controlled by a feeder-spreader device, such as a roll feeder, multiple screw feeders, or grate.

These fluidized bed dryers are potentially hazardous when air or mixtures of air and recycled gas are employed. The oxygen concentration is critical to avoid explosive conditions, and special safety equipment, such as sprinkler systems, blowout doors, and automatic fail-safe shutdown devices, is common. Additionally, the moisture content of the dry coal is often held to 5–10%, or 0.5–1.0% surface water, to make the drying operation less hazardous and to avoid excessive formation of dust. After removal of the surface water, the rising bed temperature becomes the control parameter to keep it safely below auto-ignition conditions.

Equipment to control particulate emissions from fluidized beds include combinations of cyclones, electrostatic precipitators, bag filters, and wet scrubbers. Cyclones are ineffective with particle sizes below five microns, so their operation is usually restricted to extraction of large particle dust loading prior to removal of fine dust particles by subsequent equipment. However, cyclones employed at the gas stream dew point or with water-spraying, can be nearly as effective as wet scrubbers. Electrostatic precipitators when successfully used must be kept free of condensation, and in addition, are subject to malfunctions and frequent maintenance.

Flash dryers use entrained fluidized beds to dry particles under residence times of one second or less. This short residence time gives a high capacity with a low inventory of coal, and makes them less hazardous than conventional fluidized bed dryers. However, particle fines entrainment due to the required high gas velocity is a problem, and requires additional separation equipment.

Conventional dryers, such as Multi-Louvre and Cascade, use many flights and vibrating shelves to control coal flow in the dryer. With these, maintenance is a major cost when compared to fluidized bed dryers. Roto-Louvre is a variation on a rotary drum dryer.

Modern development is exploring a number of technologies to improve coal drying processes. Hot water dewatering and decarboxylation both employ a high pressure treating reactor for altering coal micropore structures to prevent moisture reabsorption, but then additional drying becomes necessary.

Vapor recompression principles can reduce energy requirements by compressing water vapor to a higher pressure so that recycle heating can be employed. In essence much of the heat of vaporization of the water removed from the coal can be recovered. Pilot plant testing has been employed but high capital and maintenance costs are a definite drawback.

The multistage fluidized bed process achieves good thermal efficiency by recompressing water vapor from the first stage and using it to heat and fluidize the second stage. A portion of the first-stage water vapor is recycled to fluidize the bed while steam tubes provide heating.

Solar drying processes use a slurry of coal that is pumped to shallow ponds. The coal then is stockpiled for further air drying. The slurry requires large amounts of water and ponds require large amounts of land. The process is effective only in dry climates.

The Fleissner process, developed in 1927, dries coal by heating with high pressure steam. High steam temperatures change the coal structure and release water and carbon dioxide leaving a hydrophobic coal remaining for final drying. However, high steam pressures require elevated capital costs.

The Koppelman process heats coal some 400° C. above evaporative drying conditions so that partial pyrolysis occurs releasing oil; this process requires, however, extensive water cleanup because of the pyrolysis. The product coal can be almost completely dried, but hot water is typically used to cool the coal so approximately 5% water is present in the final product. This process produces enhanced heating value coal, so potentially longer transportation costs can be economically tolerated. Unfortunately, extruders are required because of the high pressure and this is a severe economic disadvantage.

Existing coal dryers can be grouped into three basic types: fluidized bed, entrained bed or flash, and shallow moving bed. The later can be further subdivided into Multi-Louvre, vertical tray and Cascade, continuous carriers, and drum type. McNally Flowdryer, Link-Belt Fluid-Flo dryer, Heyl, Patterson fluid bed dryer, and Dorr-Oliver Fluo-Solids dryer all use fluidized beds with hot air or hot gases. Flash dryers, for instance Combustion Engineering's type, use entrained bed drying with hot gas. Dryers using a shallow bed are Link-Belt Multi-Louvre, McNally fine coal Cascade, McNally Vissac, and Link-Belt Roto-Louvre.

SUMMARY OF THE INVENTION

The present invention has several objectives; they include overcoming the deficiencies of the aforementioned prior art, providing an improved process for drying coal including coal fines, providing an improved process for upgrading coal, providing coal which is not subject to spontaneous combustion, and providing dried coal which does not readily reabsorb moisture.

Coal is processed in an inclined fluidized bed dryer with staged or zonal temperature control. The inert fluidizing gas is largely carbon dioxide in later treatment stages, but may be contain other combustion products is earlier stages. The carbon dioxide, which is ideally recycled, is produced by partial decarboxylation of the coal. The coal is heated sufficiently to mobilize coal tar by pyrolysis, which seals micropores upon quenching with carbon dioxide to enhance stabilization.

DETAILED DESCRIPTION OF INVENTION

The present invention represents a process to thermally dry fine coal to produce a low-moisture product that is stabilized against moisture reabsorption, dust formation, and spontaneous combustion. Thus, the shipping weight is reduced and further surface treatment is unnecessary. The unique control capabilities of the inclined fluidized bed allow efficient operation of such process.

According to the preferred embodiment of present invention, recycled carbon dioxide, produced from partial decarboxylation of coal and representing an inert gas, dries fine coal to a low moisture content. An inclined fluidized bed operating at plug flow conditions provides excellent gas-solid contact while minimizing elutriation from the dryer. The plug flow nature of the inclined fluidized bed allows drying, tar mobilization, quenching, and cooling to occur in separate zones by control of the appropriate reactor temperature profile and solids residence time; thus producing a zonal inclined fluidized bed. The tar mobilization and subsequent quenching with carbon dioxide seals off the micropores so that moisture reabsorption is prevented. The final cooling with carbon dioxide avoids autogenous heating and leaves the product dried coal in a stabilized form so that further transfer can be simply done, such as pressing into briquettes for easy handling and shipping.

Figure 1:
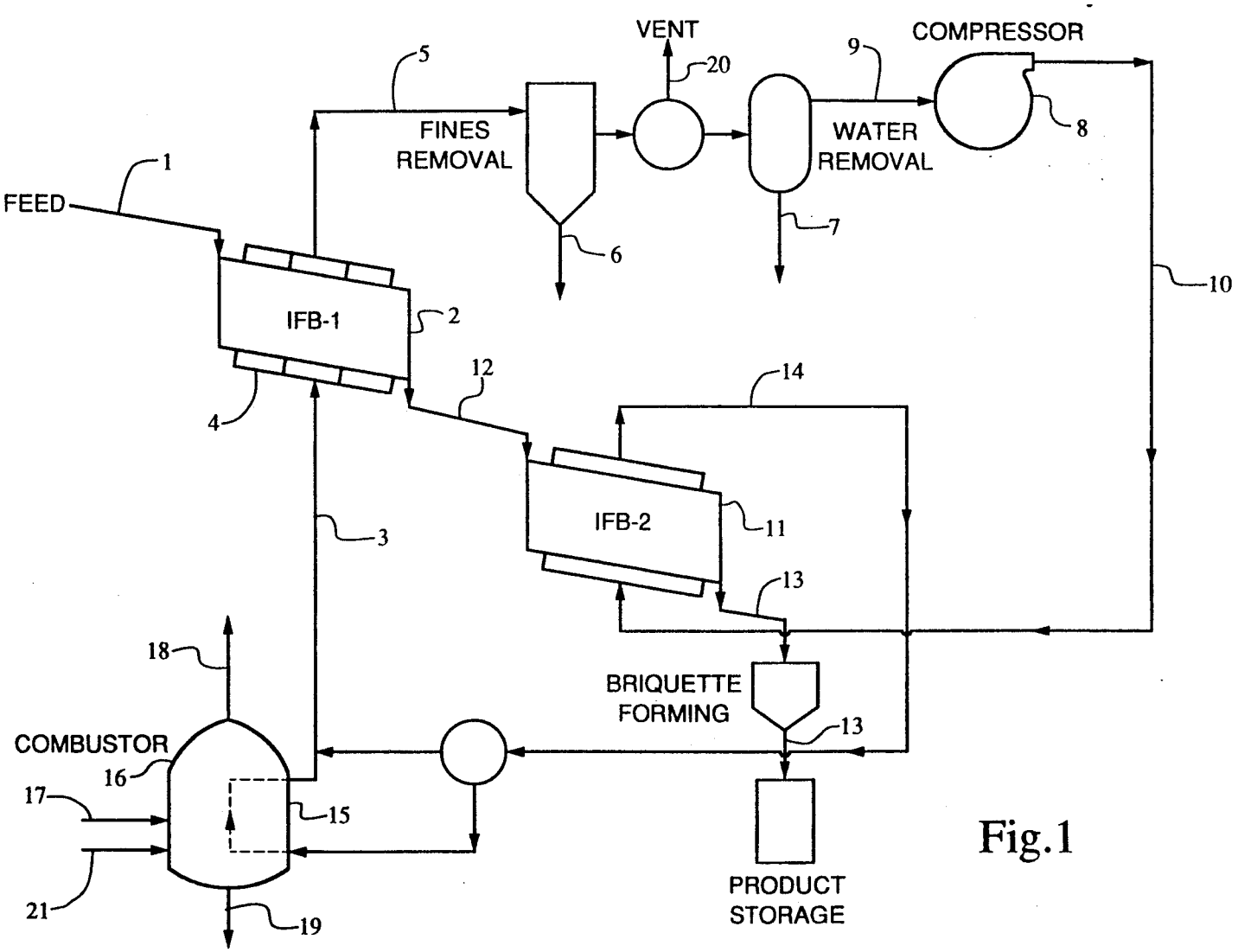
FIG. 1 shows a typical coal drying process employing inclined fluidized beds.

FIG. 1 shows a typical block flow sheet for the process showing the preferred embodiment. The process begins with feed coal, 1, which usually is predried if the initial moisture content is over 30%. Predrying avoids mechanically feeding difficulties entering the first inclined fluidized bed (IFB), 2. This coal passes through the first IFB, 2, and is fluidized by hot carbon dioxide, 3, entering its bottom plenum, 4. The exit gases, 5, from the first IFB, 2, are treated to remove fines, 6, and then cooled to remove water, 7, before the gas is compressed by blower action, 8. This gas stream, 9, now essentially carbon dioxide, is recycled, 10, back to the plenum of the second IFB, 11. The second IFB, 11, is fed by dried coal, 12, exiting from the first IFB, 2. As the dried coal exits the second IFB, 12, as product, it is briquetted, 13, before storage. Part of the gas stream, 14, exiting the second IFB, 12, flows directly to the first IFB fluidizing gas plenum, 3. The remaining off-gas from the second IFB flows through a heat exchanger, 15, in the coal combustor, 16, for heating before re-entering the inlet plenum stream, 3. The coal combustor is fed coal fines, 17, that maybe recycled from the fines removal equipment, 6, and combustion air, 21. The resulting combustor stack gases, 18, and ash, 19, are produced for disposal and in particular this flue gas is environmentally acceptable as is. Some excess carbon dioxide may be vented, 20, if leaks in the system do not compensate for the needed carbon dioxide produced in the first IFB, 2.

In an alternate formulation, the combustor gas, 18, may be employed as part of the dryer gas, 3, going to the first IFB, 2. Further, it may be used as the gas for a predryer, if employed.

In a further alternate formulation, the carbon dioxide, 10, needed as the input fluidizing gas for the second IFB can be obtained from bottled sources heated to acceptable inlet conditions; thus, recycle is not employed, and all the gas is vented, 20. In this situation, which is common for small bench-scale operation, water removal, 7, is not employed and compression of the gases, 8, is not needed since the bottle gas is at sufficient pressures to operate the system.

In a further alternate formulation, the product, 13, is not briquetted, but the dry fine coal is stored for further use, shipped via transportation equipment, or utilized directly, such as for a coal-fired power plant.

Figure 2B:
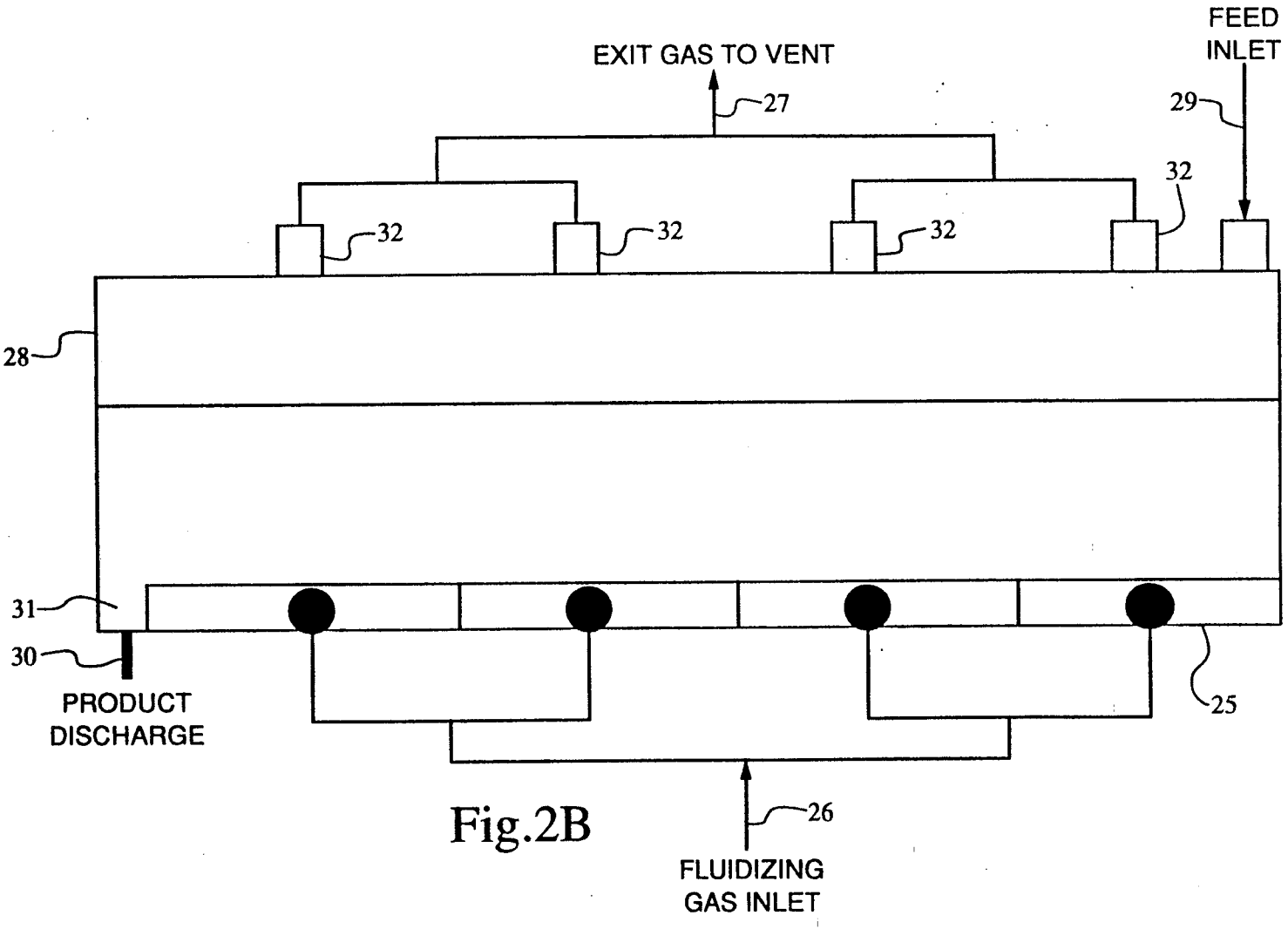
FIG. 2 shows in two views 2A and 2B a typical inclined fluidized bed bench scale equipment.
Figure 2A:
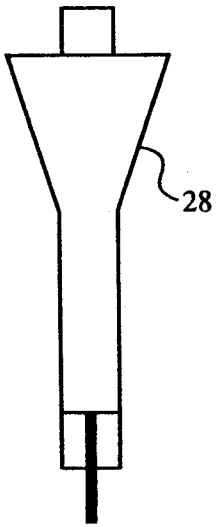

The equipment is standard except for the inclined fluidized beds, 2, and 11. FIG. 2B shows a typical drawing of an inclined fluidized bed scaled to bench operation. Main characteristics are the lower gas plenum, 25, although shown using the same inlet gas, 26, can use different gas streams along the bed length. A further optional feature could be independently controlled heaters in each inlet gas zone for necessary temperature control. Similarly, the exit gas stream, 27, is collected into one stream, but can be kept separate if desired. The design of the exist gas plenum chamber, 28, FIG. 2B is purposely to keep the pressure drop constant so that horizontal mixing of the gas fluidizing stream is minimized; thus, separate exit gas streams of different compositions are possible to collect. Further this upper plenum area, 28, is by design widened with multiple exit apertures, 32, to reduce the gas velocity and allow a disengaging space for larger entrained particles to remain in the bed region. The inlet coal, 29, enters the bed and moves approximately horizontal in plug flow as a shallow bed to the discharge position, 30, efficiently contacting the gas fluidizing stream. The inclination angle of the bed is measured from the horizontal inlet toward the outlet and is normally expressed as a positive angle in degrees. The shallow bed height can be generally controlled by the discharge baffle height, 31. This shallow bed keeps the concentration of the contacting gas essentially constant and maximizes the temperature and humidity gradients for efficient dryer operation. The plug flow prevents undesirable back-mixing. The velocity of the fluidizing gas is desirably kept at or slightly below that needed for minimum fluidization to reduce solids entrainment and to produce the desirable plug flow operation. The residence time of the material depends upon the slope of the installed inclined fluidized bed, the feed rate, and the velocity of the fluidizing gas. In the drying of coal, these appropriate parameters can be experimentally determined such that the coal product has the desired characteristics. Scaling the size of inclined fluidized beds is straight-forward because of its simple design.

The two inclined fluidized beds are used for convenience, and the residence time of the coal for the system is determined by which bed is most critical. In most designs, the first inclined fluidized bed determines the system residence time for these beds since its operating parameters are more critical. It is possible to use only one inclined fluidized bed if the inlet gas plenum is divided so that cool carbon dioxide can be employed in the final zone which then serves as cool-down region for the processed coal. This is referred to as a zonal inclined fluidizing bed.

The inclined fluidized bed serves as a dryer, reactor, and cooler for the processed coal. The fluidization of the coal particles allows efficient heat and mass transfer between the solid surface and the bulk gas phase. The equipment is operated in a plug-flow regime in order to effectively serve as a dryer. The shallow fluidized bed along with gas cross flow provides maximum humidity gradient for high mass transfer rates and allows minimum fluidization gas velocity to reduce carry-over fines to a minimum.

The reactor zone of the inclined fluidized bed performs the decarboxylation and partial coal pyrolysis reactions where carbon dioxide for recycling is produced while mobilizing coal tars. The residence time is short along with a high heating rate to maximize tar production among the many possible pyrolysis reactions. Next, a rapid cooling of the coal occurs with exposure to lower temperature carbon dioxide, and serves to quench the tar in the coal micropores to prevent future moisture reabsorption and spontaneous combustion.

The inert gas medium during this process is carbon dioxide in order to prevent explosions of ultra-fine coal and spontaneous combustion of dried coal. Further, with this final treatment the coal is left with carbon dioxide in its internal pore space. This helps to prevent moisture from reentering the pores and to exclude oxygen. Because the moisture reabsorption is exothermic, any oxygen present tends to enhance the potential for spontaneous combustion; thus, maintaining a carbon dioxide internal pore gas requirement prevents the conditions needed for spontaneous combustion.

Another advantage to this system is that the stabilized dried product coal is in excellent condition to briquette for easier handling. The operation for forming briquettes, which is simply performed with the warm product from the second inclined fluidized bed, handles the coal fines as well as the normal fine dried coal.

Further, excess fines, removed from the exit gas stream of the first inclined fluidized bed which are not burned in the combustor, can be combined in this step and also formed into briquettes.

EXAMPLE 1

Figure 3:
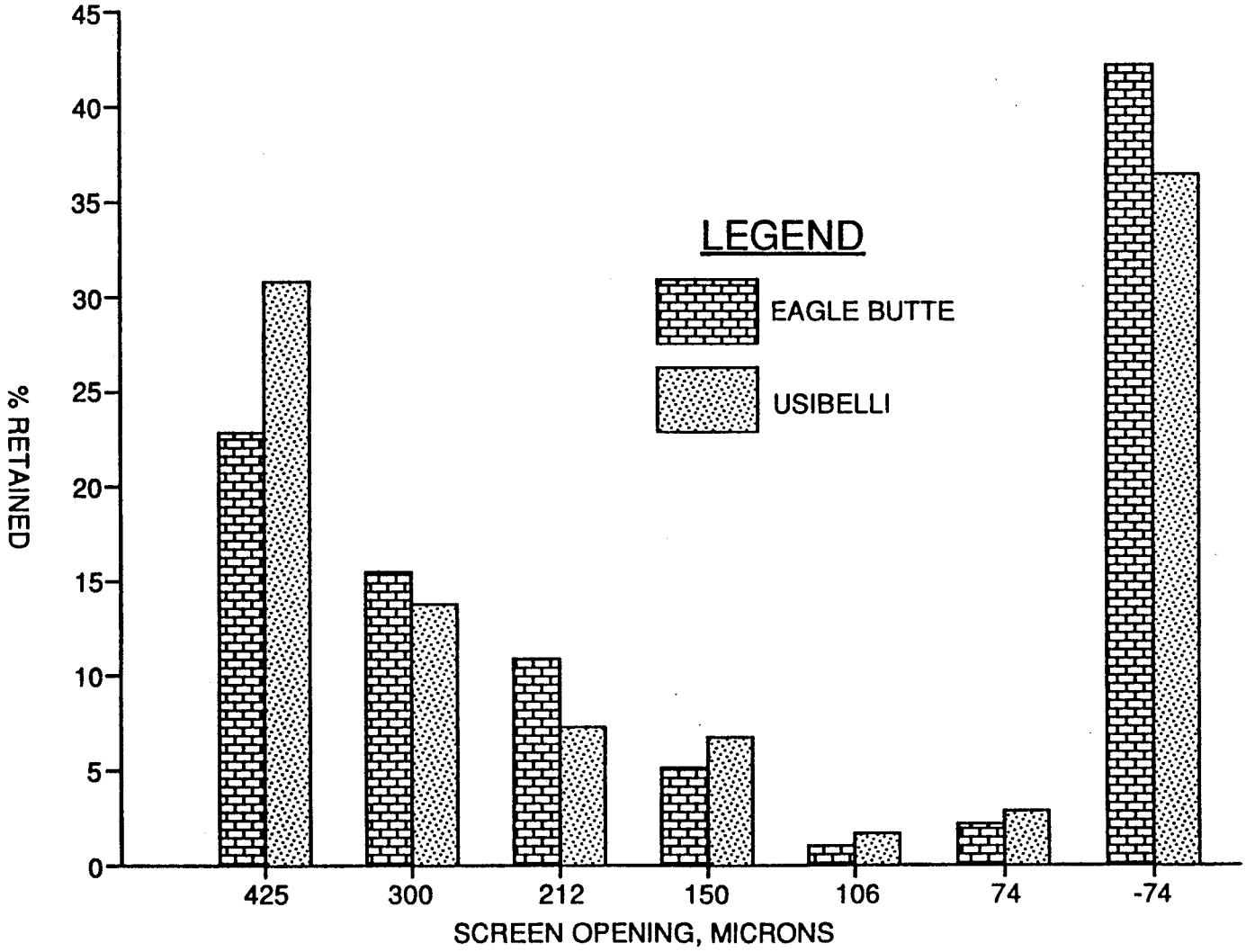
FIG. 3 shows the particle size distribution of tested crushed feed coals.

In order to dry coal, it is necessary first to investigate its characteristics in order to determine the necessary temperature settings for the inclined fluidized bed operations. In this test of the process two crushed coals were employed: Eagle Butte from Campbell County, Wyoming, and Usibelli from near Healey, Alaska. The feed coals were crushed to minus 590 microns (minus 28 mesh) to produce an average particle diameter of 70 microns for the Eagle Butte coal and 80 microns for the Usibelli coal by wet screen analysis. Since wet coal fines tend to aggregate during dry screening, wet screen analysis was employed to better characterize the fines distribution. FIG. 3 shows the particle size distributions obtained for these coals. Both coals are high-moisture subbituminous coals with "as received" moisture contents of 29% and 22% for the Eagle Butte and Usibelli coals, respectively. Coincidentally, both coals have a heating value of 8470 Btu/lb. Table 1 gives proximate, ultimate, and heating value analyses of the two coals.

Figure 4:
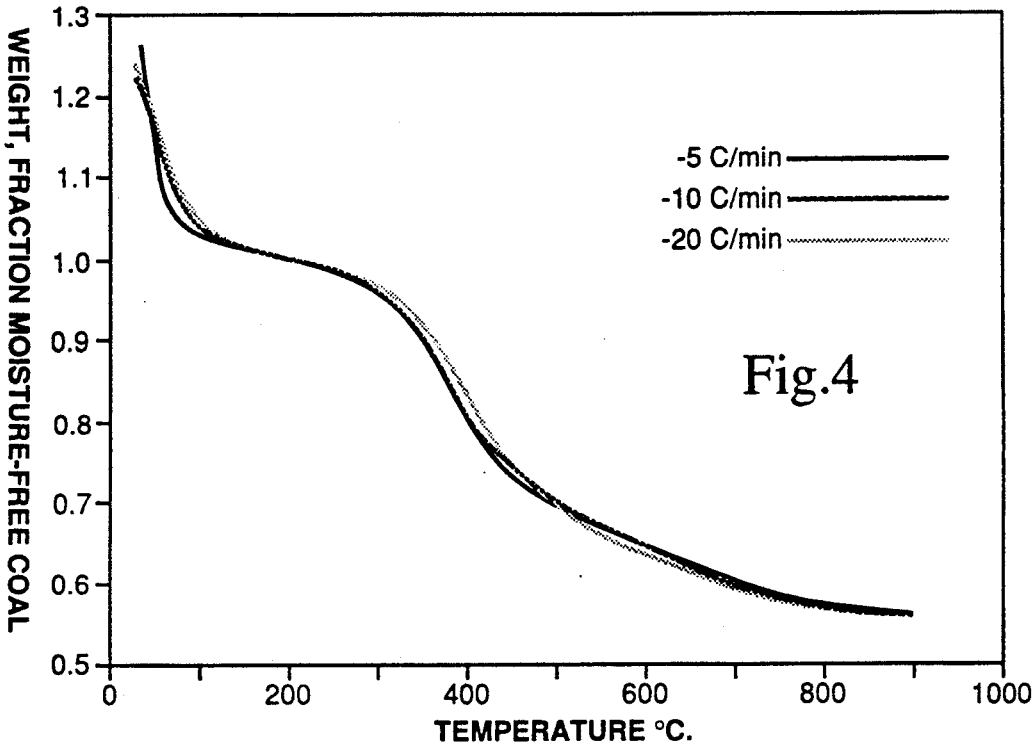
FIG. 4 shows experimental TGA weight loss curves for heating Usibelli coal.
Figure 5:
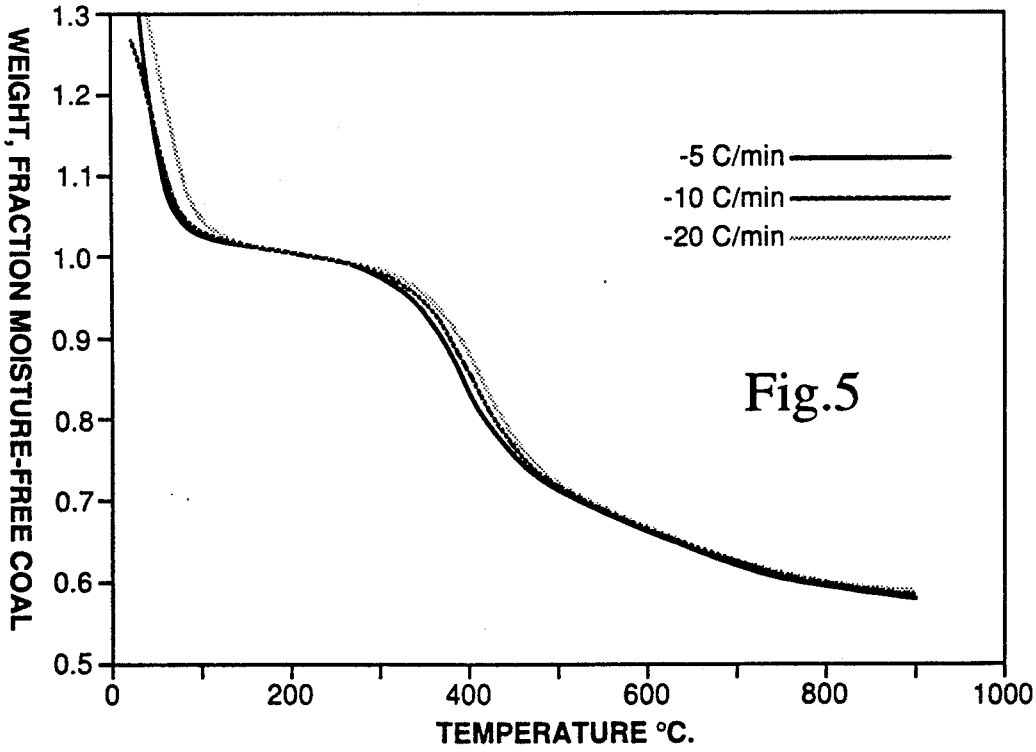
FIG. 5 shows experimental TGA weight loss curves for heated Eagle Butte coal.

Controlled tests of the rate of volatile loss from the coals as they were heated at different heating rates are summarized in FIGS. 4 and 5. The heating rate parameters on these graphs do not significantly affect the results. In all cases the moisture is effectively removed by 200° C.

TABLE 1

Results of Chemical Analyses of Feed Coals

| Analysis | Eagle Butte | Usibelli |
|---|---|---|
| Proximate (wt % as received) | | |
| Volatile Matter | 30.9 | 36.4 |
| Fixed Carbon | 35.2 | 33.3 |
| Ash | 4.7 | 8.3 |
| Moisture | 29.2 | 22.0 |
| Ultimate (wt % on dry basis) | | |
| Carbon | 67.4 | 61.5 |
| Hydrogen | 5.1 | 5.2 |
| Nitrogen | 0.9 | 0.9 |
| Sulfur | 0.6 | 0.2 |
| Oxygen | 19.4 | 21.6 |
| Ash | 6.6 | 10.6 |
| Heating value, Btu/lb | 8470 | 8470 |

At higher temperatures gases other than water are emitted as pyrolysis becomes important. Further gas analysis by component indicated that hydrogen gas has maximum rates of evolution just above 400° C. Methane has a broader evolution peak with a maximum near 500° C. Ethene has a maximum rate of evolution near 400° C. but also evolves at a lower rate to 800° C. Carbon dioxide has a broad evolution profile starting near 100° C. and extending to 1000° C. with a maximum near 400° C.

Hydrogen is not formed in significant amounts below 500° C. These results are valid for both coals. These conversion studies indicate that for both coals significant pyrolysis conversion starts at near 250° C. with predominately carbon dioxide formed as the gaseous product below 400° C.; however, as the carbon dioxide forms, these pyrolysis reactions will also produce considerable liquid tar.

From the above information the preferred embodiment optimum operating conditions are to keep the bed temperature below 200° C. (392° F.) for only drying. This will evolve moisture without allowing any significant pyrolysis to occur. Then rapid heating to near 350° C. (662° F.) will evolve carbon dioxide and mobilize tar. Quenching to below 250° C. (482° F.) will stop the pyrolysis, and slow the flow of the tar.

Figure 6:
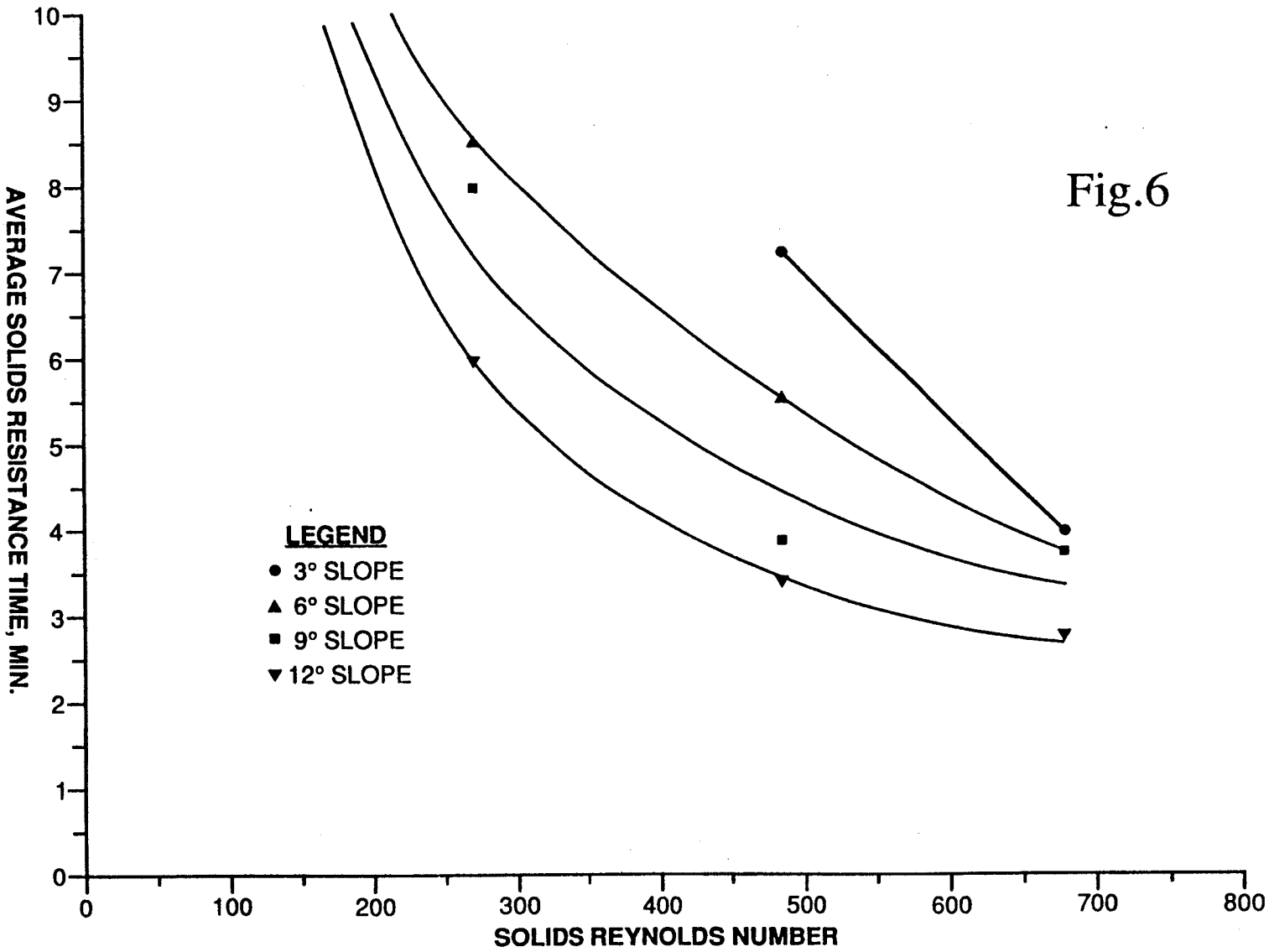
FIG. 6 shows inclined fluidized bed cold flow experimental results using Eagle Butte coal.
Figure 7:
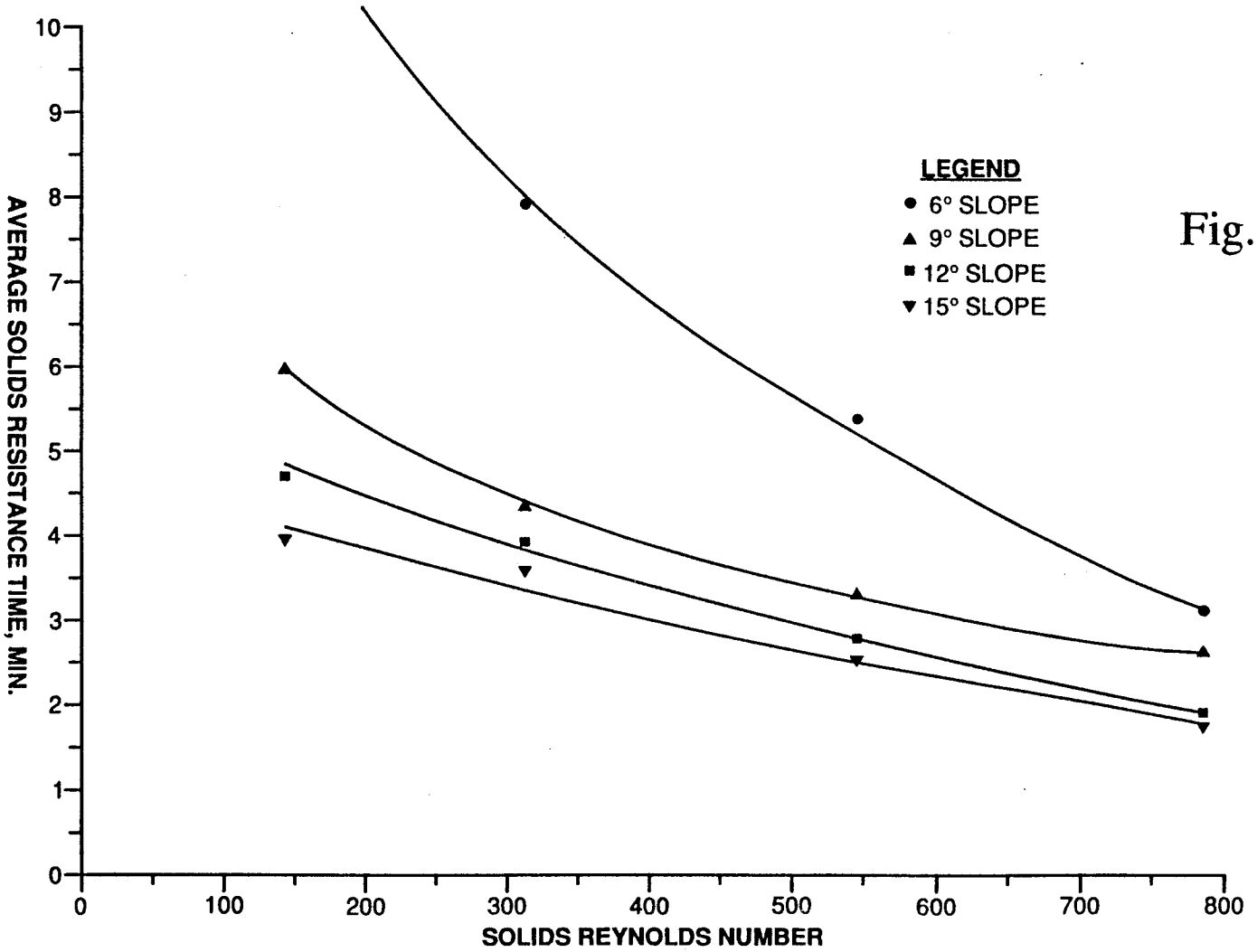
FIG. 7 shows inclined fluidized bed cold flow experimental results using Usibelli coal.

A series of cold flow experiments were run to determine the solids residence time relationship to the gas-flow conditions with the slope of the inclined fluidized bed as a parameter. If too low a gas velocity is employed, the material will plug the inclined fluidized bed. The correlation was made using a solid Reynolds number thus:

$$N_{RE}=[D_S V_G P_S][u_G]^{-1};$$

where $N_{RE}$ is the solids Reynolds number, $D_S$ is the average diameter of the solid particles, $V_G$ is the fluidizing gas velocity, $P_S$ is the solid particles density, and $u_G$ is the gas viscosity. Units are appropriately picked to make this solids Reynolds number dimensionless. FIGS. 6 and 7 show the results of these cold-flow test correlations. These allow operating conditions to be rapidly obtained for a wide range of process conditions.

EXAMPLE 2

With the previous information obtained in Example 1, bench drying runs were made at various slopes of the inclined fluidized bed. The feed rate was approximately ten pounds per hour, controlled by a mechanical feeder, for these small scale tests, and carbon dioxide from the process was not recycled, but instead a separate pressured supply of carbon dioxide was used. Tables 2 and 3 give the results for a series of four hour runs with an occasional twelve hour run utilized. The experimental yield values are presented as percentages of the total feed coal as summarized in Table 1.

The product coal can be safely handled in a number of ways including briquetting, direct bagging, transfer by mechanical or other means to a storage area, or even as feed stock for additional coal processing.

It is evident that the product coal has been dried to a very low moisture content for in all instances the moisture content was below 1.5%. The heating values of the Eagle Butte dried product coals tested in the range of 11,800 to 12,600 Btu/lb. Compared to the feed value of 8,470 Btu/lb, this is a significant enhancement in product value. Similar improvement would be expected for the Usibelli dried coal product from the information shown in Table 3. Additionally, the process stability allowed operation over an extended time period.

To further test the characteristics of the product coal, moisture reabsorption, dust content, and spontaneous heating tests were performed.

TABLE 2

Summary of Experimental Yields for IFB Bench-Scale Drying Tests using Eagle Butte Feed Coal

| Reactor Slope, degrees | Gas to Solids, lb/lb | Average Dryer Temperature, °F. | Experimental Yield %: Product | Gas | Entrained Solids | Water |
|---|---|---|---|---|---|---|
| 3 | 4.9 | 589 | 29.6 | 4.7 | 35.0 | 28.0 |
| 3 | 2.7 | 531 | 57.0 | 2.5 | 11.6 | 28.2 |
| 3[a] | 3.9 | 695 | 36.7 | 8.8 | 28.4 | 28.9 |
| 6 | 2.7 | 595 | 34.0 | 2.2 | 38.5 | 27.2 |
| 6 | 4.0 | 599 | 38.3 | 3.3 | 35.3 | 21.9 |
| 6 | 4.1 | 623 | 58.0 | 2.7 | 20.5 | 20.9 |
| 6 | 2.5 | 666 | 50.7 | 7.5 | 12.3 | 26.9 |
| 6[a] | 3.0 | 684 | 47.9 | 10.1 | 13.4 | 26.1 |
| 9 | 4.6 | 617 | 39.5 | 4.1 | 32.0 | 24.1 |
| 9 | 3.6 | 589 | 47.4 | 5.5 | 16.1 | 27.1 |
| 9 | 2.3 | 588 | 57.0 | 5.8 | 7.7 | 27.2 |
| 9 | 4.8 | 692 | 21.0 | 7.6 | 40.9 | 26.9 |
| 9[a] | 1.5 | 611 | 52.6 | 5.7 | 11.1 | 29.1 |
| 12 | 1.4 | 603 | 55.9 | 3.6 | 13.7 | 25.5 |
| 12 | 1.3 | 649 | 55.9 | 7.1 | 6.7 | 26.1 |
| 12 | 2.3 | 682 | 45.5 | 9.2 | 15.1 | 27.8 |
| 15 | 1.4 | 645 | 55.8 | 4.8 | 9.3 | 27.6 |
| 15 | 1.4 | 377 | 63.6 | 0.9 | 10.1 | 23.9 |
| 15 | 0.7 | 589 | — | — | — | — |
| 15[a] | 1.4 | 731 | 52.8 | 15.1 | 8.7 | 20.4 |

[a]Experiment of nominally 12-hr duration

TABLE 3

Summary of Experimental Yields for IFB Bench-Scale Drying Tests using Usibelli Feed Coal

| Reactor Slope, degrees | Gas to Solids, lb/lb | Average Dryer Temperature, °F. | Experimental Yield %: Product | Gas | Entrained Solids | Water |
|---|---|---|---|---|---|---|
| 3 | 2.6 | 494 | 70.9 | 6.9 | 9.3 | 13.4 |
| 3 | 3.4 | 705 | 50.6 | 15.0 | 14.9 | 17.2 |
| 3 | 3.7 | 690 | 33.1 | 14.8 | 31.3 | 18.1 |

TABLE 3-continued

Summary of Experimental Yields for IFB Bench-Scale Drying Tests using Usibelli Feed Coal

| Reactor Slope, degrees | Gas to Solids, lb/lb | Average Dryer Temperature, °F. | Experimental Yield %: Product | Gas | Entrained Solids | Water |
|---|---|---|---|---|---|---|
| 3 | 3.4 | 605 | 49.7 | 10.6 | 20.1 | 18.7 |
| 3[a] | 4.0 | 611 | 54.2 | 8.3 | 15.3 | 20.5 |
| 6 | 2.7 | 690 | 53.9 | 13.3 | 13.6 | 17.3 |
| 6 | 2.1 | 675 | 52.8 | 17.2 | 6.2 | 20.0 |
| 6 | 3.3 | 695 | 56.0 | 14.0 | 7.0 | 19.6 |
| 6 | 2.8 | 564 | 64.9 | 5.9 | 8.0 | 18.8 |
| 6[a] | 2.6 | 664 | 55.9 | 13.9 | 11.8 | 16.6 |
| 9 | 2.6 | 637 | 55.7 | 9.2 | 10.4 | 22.1 |
| 9 | 2.7 | 571 | 43.9 | 6.6 | 27.7 | 20.0 |
| 9 | 1.9 | 603 | 64.9 | 8.0 | 5.4 | 21.7 |
| 9 | 3.8 | 707 | 44.1 | 12.8 | 22.3 | 18.6 |
| 9[a] | 1.9 | 632 | 60.9 | 10.2 | 10.2 | 17.8 |
| 12 | 1.5 | 632 | 66.0 | 7.4 | 8.6 | 18.4 |
| 12 | 1.3 | 653 | 63.7 | 7.7 | 10.0 | 17.9 |
| 12 | 2.3 | 692 | 58.5 | 12.1 | 9.9 | 15.8 |
| 15 | 1.3 | 648 | 66.6 | 7.2 | 7.1 | 20.0 |
| 15 | 1.4 | 364 | 69.3 | 3.7 | 5.5 | 19.3 |
| 15 | 0.7 | 594 | — | — | — | — |
| 15[a] | 1.3 | 752 | 60.3 | 15.3 | 6.3 | 15.4 |

[a]Experiment of nominally 12-hr duration

The moisture reabsorption test exposed samples of product coal to 95% relative humidity at 30° C. for five days. Typical results were that the new level of equilibrium moisture after reabsorption was approximately half that of the feed coal. The higher the average drying temperature, the lower the new equilibrium moisture value became. In actual instances 95% relative humidity may not always be encountered and lower values better represent more realistic conditions. At 50% relative humidity at 30° C. for five days, the new equilibrium moisture level was only about one-third that of the feed coal, and indicated the success of the pyrolysis tar mobilization and quenching to prevent moisture reabsorption.

Dust tests were performed using opacity meter measurements on product samples of both coals. These test results confirmed that the dried coal products contained very low levels of dust compared to the feed samples.

Spontaneous heating test were run under the standard conditions: 70° C. starting temperature with heating exposed to 160 cc/min oxygen saturated with moisture. Ignition time or a 300° C. coal temperature ended each test. Table 4 gives the results which show that the product coal self-heats quicker by a factor of two to three when compared to the feed. This produces a better product combustion for future use but also makes the final carbon dioxide pore treatment important for storage safety.

A further verification of the process is that the bed temperature shown in Tables 2 and 3, which is an average of several test positions, falls generally in the range of the previously determined expected value of approximately 350° C. (662° F.).

It is noted that although some bed inclination angles would be preferred because of lower fines carry-over, the drying operation can be successfully operated over a wide range of such angles.

TABLE 4

Effect of Drying Conditions on Surface Area and Self-Heating Characteristics

| Coal Type | Test Number | Reactor Slope | Drying temp, °F. | Sample Location | Surface Area $m^2/g$ | Self-heating Time, min, to reach 200° C. |
|---|---|---|---|---|---|---|
| Eagle Butte | — | — | — | Avg. Feed | 4.1 | 160 |
| | D-2 | 3 | 586 | Product | 4.8 | 145 |
| | D-30 | 3 | 531 | Product | 4.7 | 70 |
| | D-31 | 3 | 695 | Product | 4.2 | 45 |
| | D-37 | 6 | 684 | Product | 3.5 | — |
| | D-39 | 9 | 611 | Product | 3.0 | 75 |
| | D-53 | 15 | 731 | Product | 3.2 | 60 |
| Usibelli | — | — | — | Avg Feed | 1.7 | >150 |
| | D-29 | 3 | 494 | Product | 0.7 | 130 |
| | D-32 | 3 | 705 | Product | 0.9 | 40 |
| | D-35 | 3 | 611 | Product | 0.9 | 75 |
| | D-36 | 6 | 664 | Product | 1.9 | 52 |
| | D-38 | 9 | 631 | Product | 1.4 | 60 |
| | D-52 | 15 | 752 | Product | 2.3 | 50 |

EXAMPLE 3

Figure 8:
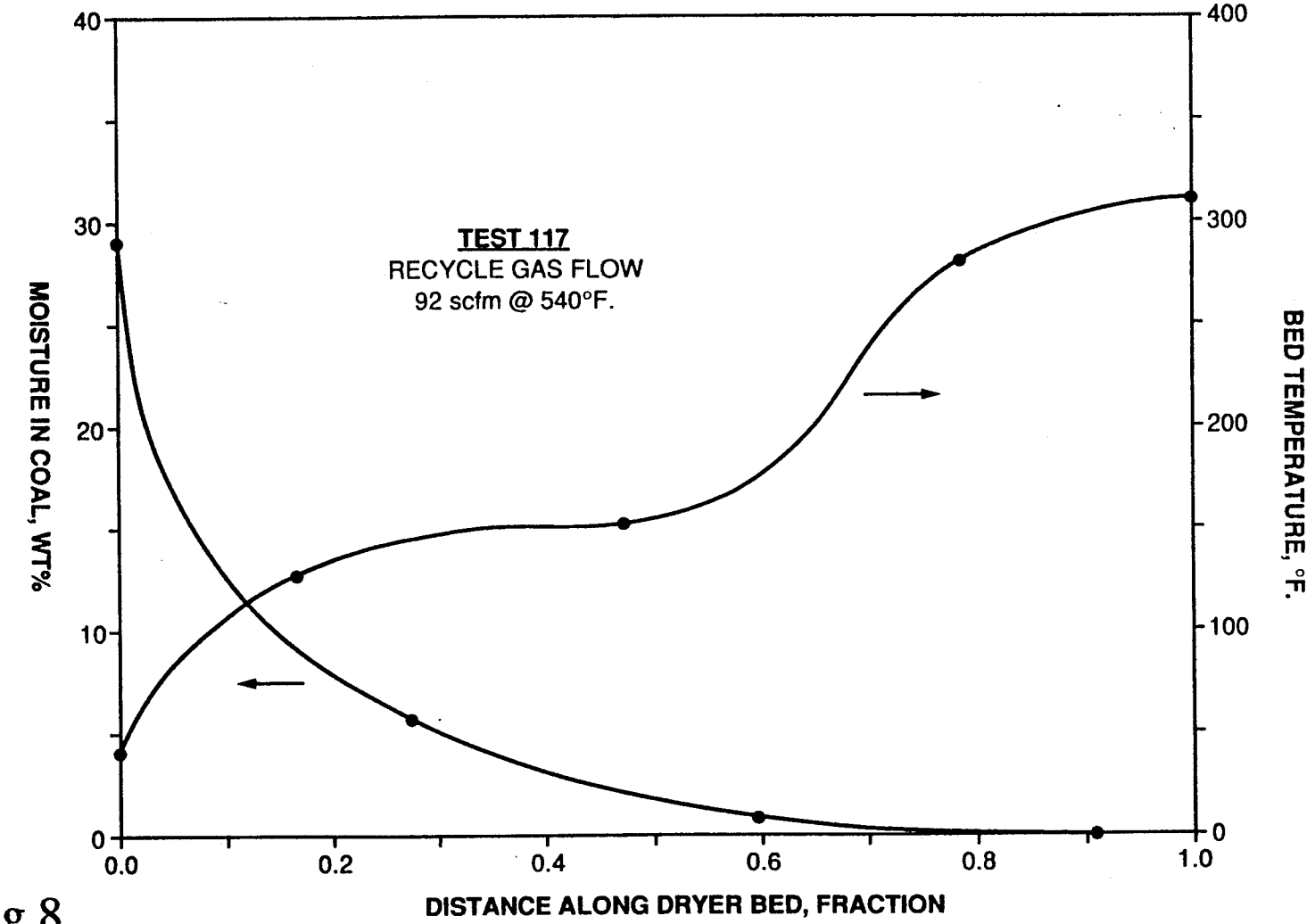
FIG. 8 shows moisture and temperature conditions during a typical larger test run.

A series of larger test were performed on a pilot plant process system that was designed for approximately 100 pounds per hour feed rate of coal. This feed coal was Eagle Butte with the properties given in Example 1. The system was designed for mild coal gasification, and the drying aspects were only the first part of the process; however recycle carbon dioxide was employed. Therefore, two inclined fluidized beds were employed;

the first was principally a coal dryer, the second the mild coal gasification unit. The results shown in FIG. 8 represents approximately a 24 hour pilot plant run for the first inclined fluidized bed and gives comparable results to the previous smaller scale experiments. In this instance the inflection point on the bed temperature curve occurred at approximately the midpoint of the bed; thus, indicating the start of significant pyrolysis forming carbon dioxide.

Since the product coal was normally not separately removed but continued directly on to mild coal gasification, the drying bed temperature was not raised to the pyrolysis tar mobilization temperature. Nearly complete moisture removal, however, was easily obtained as shown in FIG. 8. This drying curve well illustrates the characteristic sections associated with free, physically bound, and chemically bound moisture.

The test parameters for the illustrated number 117 run were: coal feed rate, 119 lb/hr; coal residence time, 3 min; recycle gas flow, 92 scfm; fluidizing gas temperature, 540° F.; dryer zone temperatures, °F.: No. 1, 128; No. 2, 151; No. 3, 284.

The recycle carbon dioxide generally tested out at better than 95%, after moisture and fines removal from the dryer exit gas, even after many hours operation of the pilot plant. For this run the dryer produced 5.5% fines, 29.8% moisture, and 0.9% gas, with a basis of 100% for the feed and all percentages are by weight. It is to be noted that the percentage of fines as presented represents the fines produced only in the dryer; for these pilot plant operations the feed coal had had its fines significantly removed before processing.

The product coal can be safely handled in an appropriate manner as indicated in Example 2.

It is noted that this feed coal in Table 1 analyzed at 29.2% moisture; therefore, essentially complete removal was obtained.

The foregoing description of the specific embodiments will so fully reveal the general nature of the invention that other can, by applying current knowledge, readily modify and/or adapt for various applications such specific embodiments without departing from the generic concept, and therefore such adaptations are modifications are intended to be comprehended within the meaning and range of equivalents of the disclosed embodiments. It is to be understood that the phraseology or terminology herein is for the purpose of description and not of limitation.

We claim:

1. A process for the drying and stabilizing of fine coal comprising:

employing a zonal inclined fluidized bed containing coal and using an inert fluidizing gas;

means for feeding coal;

means for selectively heating said gas;

means for rapidly quenching said fluidized bed; and means for collecting products.

2. The process according to claim 1 wherein said zonal inclined fluidized bed further comprises operating with an inclination angle of from zero to about 15 degrees.

3. The process according to claim 1 wherein employing said zonal inclined fluidized bed further comprises using multiple one-zone inclined fluidized beds.

4. The process according to claim 1 wherein said means for feeding coal further comprises using a zonal inclined fluidized bed.

5. The process according to claim 1 wherein said means for feeding coal further comprises using coal containing fines.

6. The process according to claim 1 wherein said means for feeding coal further comprises employing mechanical equipment.

7. The process according to claim 1 wherein said inert fluidizing gas further comprises substantially carbon dioxide.

8. The process according to claim 1 wherein said inert fluidizing gas further comprises recycle carbon dioxide from coal pyrolysis.

9. The process according to claim 1 wherein said inert fluidizing gas further comprises combustion gas.

10. The process according to claim 1 wherein said inert fluidizing gas further comprises employing near minimum fluidization velocities.

11. The process according to claim 1 wherein said means for selectively heating said gas further comprises partial pyrolysis of said coal.

12. The process according to claim 11 wherein said partial pyrolysis further comprises producing substantially carbon dioxide as the gaseous product.

13. The process according to claim 11 wherein said partial pyrolysis further comprises producing minute amounts of liquid tars remaining in the micropores of said coal.

14. The process according to claim 1 wherein said means for selectively heating said gas further comprises employing a gas plenum providing for multiple separately heated fluidizing gas inlets.

15. The process according to claim 1 wherein said means for selectively heating said gas further comprises using multiple internal heaters selectively positioned within each said fluidized bed zone.

16. The process according to claim 1 wherein said means for selectively heating said gas further comprises producing near bone-dry product coal.

17. The process according to claim 1 wherein said means for rapidly quenching said fluidized bed containing coal further comprises employing cooled inert gas.

18. The process according to claim 15 wherein said cooled inert gas further comprises employing cooled fluidizing gas.

19. The process according to claim 1 wherein said means for rapidly quenching said fluidized bed further comprises stabilizing said product coal against moisture reabsorption.

20. The process according to claim 1 wherein said means for rapidly quenching said fluidized bed further comprises stabilizing said product coal against reheating hazards.

21. The process according to claim 1 wherein said means for product collection further comprises employing a stabilized dried coal transfer system.

22. The process according to claim 21 wherein said stabilized dried coal transfer system further comprises employing a fluidized bed.

23. The process according to claim 21 wherein said stabilized dried coal transfer system further comprises employing a briquetting operation.

24. The process according to claim 21 wherein said stabilized dried coal transfer system further comprises employing a bagging operation.

25. A process for the drying and stabilizing of fine coal comprising:

employing a zonal inclined fluidized bed using a coal feeder and an inert fluidizing gas;

means for selectively drying said coal;
means for selectively pyrolyzing said coal;
means for rapidly quenching said coal; and employing a product coal transfer system.

26. The process according to claim 25 wherein said zonal inclined fluidized bed further comprises operating with inclination angles of from about 3 to 15 degrees.

27. The process according to claim 25 wherein said zonal inclined fluidized bed further comprises operating under plug flow conditions.

28. The process according to claim 25 wherein said coal feeder further comprises using a zonal inclined fluidized bed.

29. The process according to claim 25 wherein said coal feeder further comprises using mechanical means.

30. The process according to claim 25 wherein said coal feeder further comprises designing for high moisture coal feed.

31. The process according to claim 25 wherein said inert fluidizing gas further comprises substantially carbon dioxide.

32. The process according to claim 31 wherein said carbon dioxide further comprises recycled carbon dioxide from pyrolysis of coal.

33. The process according to claim 25 wherein said inert fluidizing gas further comprises combustion gas.

34. The process according to claim 25 wherein said zonal inclined fluidized bed further comprises using a divided inlet gas plenum allowing different temperature gas streams to fluidize said coal.

35. The process according to claim 34 wherein said different temperature gas streams further comprises external heating.

36. The process according to claim 34 wherein said different temperature gas streams further comprises internal heating within said plenum.

37. The process according to claim 34 wherein said different temperature gas streams further comprises internal heating within said fluidized coal bed.

38. The process according to claim 25 wherein said means for selectively drying said coal further comprises reaching a fluidized coal temperature of about 250° C.

39. The process according to claim 25 wherein said means for selectively drying said coal further comprises producing product coal dried to below about three percent moisture content.

40. The process according to claim 25 wherein said means for selectively pyrolyzing said coal further comprises reaching a fluidized coal temperature of about between 250° C. and 350° C.

41. The process according to claim 25 wherein said means for selectively pyrolyzing said coal further comprises producing substantially carbon dioxide.

42. The process according to claim 25 wherein said means for selectively pyrolyzing said coal further comprises producing sufficient liquid pyrolysis tars to approximately obstruct the micropores of said coal.

43. The process according to claim 25 wherein said means for rapidly quenching said coal further comprises solidifying liquid coal tars within the micropores of said coal.

44. The process according to claim 25 wherein said means for rapidly quenching said coal further comprises stabilizing said coal against spontaneous combustion and moisture reabsorption.

45. The process according to claim 25 wherein said means for rapidly quenching said coal further comprises cooling with substantially carbon dioxide below a temperature of 250° C.

46. The process according to claim 45 wherein said carbon dioxide further comprises filling the micropores of said coal against moisture and oxygen penetration.

47. The process according to claim 25 wherein said product coal transfer system further comprises using mechanical bagging.

48. The process according to claim 25 wherein said product coal transfer system further comprises using briquettes.

49. The process according to claim 25 wherein said product coal transfer system further comprises employing a zonal inclined fluidized bed.

50. A process for the drying and stabilizing of fine coal comprising:
employing a three zone inclined fluidized coal bed with carbon dioxide as the fluidizing medium;
using zone one for drying said coal;
using zone two for partial pyrolysis of said coal;
using zone three for rapid quenching of said coal; and employing a product coal collector.

51. The process according to claim 50 wherein said zonal inclined fluidized bed further comprises operating at about 5 degrees inclination.

52. The process according to claim 50 wherein said coal bed further comprises feeding coal with fines.

53. The process according to claim 50 wherein said carbon dioxide further comprises being recycled from fluidized coal pyrolysis.

54. The process according to claim 50 wherein said zone one further comprises heating said fluidized coal to about the range 200° to 250° C.

55. The process according to claim 50 wherein said zone two further comprises heating said fluidized coal to about 350° C.

56. The process according to claim 50 wherein said zone three further comprises quenching said fluidized coal to about below 200° C.

57. The process according to claim 50 wherein said zone one further comprises producing coal that is dried to about below one percent moisture content.

58. The process according to claim 50 wherein said zone two further comprises producing a gas product of substantially carbon dioxide.

59. The process according to claim 50 wherein said zone two further comprises producing mobile liquid tars within said coal micropore space.

60. The process according to claim 50 wherein said zone three further comprises solidifying said tars blocking said coal micropore space to stabilize the product coal by prohibiting reabsorption of moisture and oxygen.

61. The process according to claim 50 wherein said zone three further comprises filling said coal pore space with carbon dioxide to stabilize the product coal by preventing reheating and allow safe handling.

62. The process according to claim 50 wherein said product coal collector further comprises bagging.

63. The process according to claim 50 wherein said product coal collector further comprises briquetting.

64. The product produced by the process of claim 1.

65. The product produced by the process of claim 25.

66. The product produced by the process of claim 50.

* * * * *